US006271451B1

(12) United States Patent
Gress

(10) Patent No.: US 6,271,451 B1
(45) Date of Patent: Aug. 7, 2001

(54) DRUMSTICK

(76) Inventor: Philip George Gress, 414 Sixth St., East Northport, NY (US) 11731

( * ) Notice: Subject to any disclaimer, the term of this patent is extended or adjusted under 35 U.S.C. 154(b) by 0 days.

(21) Appl. No.: 09/575,427

(22) Filed: May 22, 2000

(51) Int. Cl.[7] ..... G10D 13/02
(52) U.S. Cl. ..... 84/422.4
(58) Field of Search ..... 84/422.4; D17/22

(56) References Cited

U.S. PATENT DOCUMENTS

| | | | | |
|---|---|---|---|---|
| D. 368,110 | * | 3/1996 | Roos | D17/22 |
| 4,462,296 | * | 7/1984 | Heiskell | 84/422 S |
| 4,651,617 | * | 3/1987 | Schwartz | 84/422 S |
| 4,702,143 | | 10/1987 | Brochstein . | |
| 4,905,566 | | 3/1990 | Hughlett et al. . | |
| 5,341,716 | * | 8/1994 | Donohoe | 84/422.4 |
| 5,477,768 | | 12/1995 | Swift . | |
| 5,503,056 | | 4/1996 | Evans . | |
| 6,028,260 | | 2/2000 | Lalonde . | |

* cited by examiner

*Primary Examiner*—Bentsu Ro
*Assistant Examiner*—Kim Lockett

(57) ABSTRACT

An improved drumstick comprising a body, a percussion means, an end, a longitudinal axis extending through the body and the end, and a pivot knob attached to the body at a predetermined distance between the percussion means and the end of the drumstick. The pivot knob comprising two surfaces, each surface swiveably attached to drumstick at a fulcrum. The swivelable attachment of the knob provides a frictionless point for gripping the drumstick so as to enhance the movement of the drumstick when used by a percussionist.

38 Claims, 3 Drawing Sheets

DRUMSTICK

BACKGROUND OF THE INVENTION

This invention relates to a drumstick, more particularly to an improved drumstick comprising an essentially frictionless fulcrum that enables a percussionist to manipulate the drumstick with greater speed and precision than conventional drumsticks.

DESCRIPTION OF THE PRIOR ART

It is well known in the art that numerous improvements have been made to drumsticks since their creation. For example, U.S. Pat. No. 4,702,143 issued to Irwin H. Brochstein, discloses a drumstick with a hollow portion that provides a means for producing a mellow tone quality, not otherwise present when the drumstick is used on a percussion surface.

Another patent, U.S. Pat. No. 6,028,260 issued to Anthony F. LaLonde, describes a drumstick incorporating an adjustable center of gravity for optimum balance. This drumstick contains a hollow interior containing an elongated threaded spindle that extends nearly the entire length of the drumstick. Adjustably mounted on the spindle are one or more weights that can be repositioned on the spindle to effectively adjust the balance of the drumstick.

Still another patent directed to the improvement of a drumstick is U.S. Pat. No. 4,905,566 issued to David J. Hughlett et al. that discloses a rotationally balanced drumstick. This patent discloses a drumstick having a weight, preferably a heavy weight such as a lead weight, inserted into a hole at the butt portion of the drumstick that is fixed in place. The fixed weight provides rotational balance to the drumstick.

Still yet another patent directed to an improvement to a drumstick is U.S. Pat. No. 5,477,768 issued to Donald J. Swift that discloses a multipurpose drum ball joint simulator. This patent teaches a drumstick having a rubber or other elastic material ball mounted on the stick's shaft so as to provide a ball grip that fits in the palm of the percussionist's hand. This ball grip provides additional grip to the stick and thus enhances the performance of the stick.

While these devices fulfill their respective, particular objectives and requirements, the aforementioned patents do not disclose a drumstick having a means for frictionless movement of the drumstick, which is an essential movement in drumming. In fact, the addition of weights, spindles and ball grips actually increase the friction between the fingers/hands of the percussionist and the drumstick and thus decrease the speed in which a percussionist can achieve while using that drumstick.

In these respects, the reduced friction drumstick of the present invention departs from the conventional concepts and designs of the prior art, and in doing so provides an apparatus primarily designed to reduce the friction between the fingers/hands of the percussionist and the drumstick.

SUMMARY OF THE INVENTION

The drumstick according to the present invention comprises an elongated tubular body having a first end and a second end, each of which are at opposite ends of the elongated tubular body. Continuous with the first end of the elongated tubular body is a striking tip. Continuous with the second end of the elongated tubular body is the butt portion of the drumstick. The drumstick also comprises a pivot means that is swivelably attached to the elongated tubular body between the first and second ends of the drumstick.

The pivot means of the drumstick comprises a first member and a second member that are attached to the elongated body by a pivot point. The pivot point can be a rod shaped member that extends from one member of the pivot means through the drumstick to the second member of the pivot means. In other words, the first and second members of the pivot means are attached to opposite sides of the elongated tubular body and pivot about the pivot point.

The pivot point can be a pin shaped member having a circular cross-section and extending within semi-circular transverse slots defined in the first and second members of the pivot means and a point of attachment on the elongated tubular body.

The pivot means is connected to the drumstick in such a way that the first end of elongated tubular body of the drumstick moves in an opposite direction in relationship to the front portion of the pivot means. In other words, when the front portion of the pivot means moves above the longitudinal axis of the elongated tubular body, the first end of the elongated tubular body moves below the longitudinal axis of the elongated tubular body. Similarly, when the front portion of the pivot means moves below the longitudinal axis of the elongated tubular body, the first end of the elongated tubular body moves above the longitudinal axis of the elongated tubular body.

A rapid succession of these positions, i.e., above the longitudinal axis of the elongated tubular body to below the longitudinal axis of the elongated tubular body, allows the percussionist to move the drumstick in a rapid movement.

In another embodiment, the first and second members of the pivot means are pivotally mounted within a cavity defined in the elongated tubular body of the drumstick so that their outer surfaces are flush with the rest of the elongated tubular body of the drumstick.

In still another embodiment, the pivot means further comprises a plurality of ball bearing units that are axially retained and concentrically connected to the pivot point. This arrangement enables the pivot pin and thus the rest of the drumstick to rotate about a longitudinal axis of the pivot means.

In another embodiment of the invention, the pivot means is continuous with the longitudinal axis of the elongated tubular body and comprises a ball having a circular cross-section and first and second grip members. Each of the first and second grip members have an outside surface that faces away from the ball and an inside surface that faces towards the ball. At least a portion of the inside surfaces are in contact with the ball so that the first and second grip members swivel about the ball in a circular motion.

In yet another embodiment of the invention, the grip is an elongated tube having a longitudinally positioned bore wherein the ball is set forth within the bore. This arrangement allows the elongated grip to move about the ball allowing the percussionist to hold the grip from any position, i.e., from the top to the bottom, side to side or any angle desired.

A cross section of the elongated tubular body reveals a center portion of the ball that attaches to the center portion of the elongated body by a front support member and a rear support member. The front portion of the first and second grip members move in an opposite direction compared the first end of the elongated tubular body.

DETAILED DESCRIPTION OF THE INVENTION

Figure 1A:
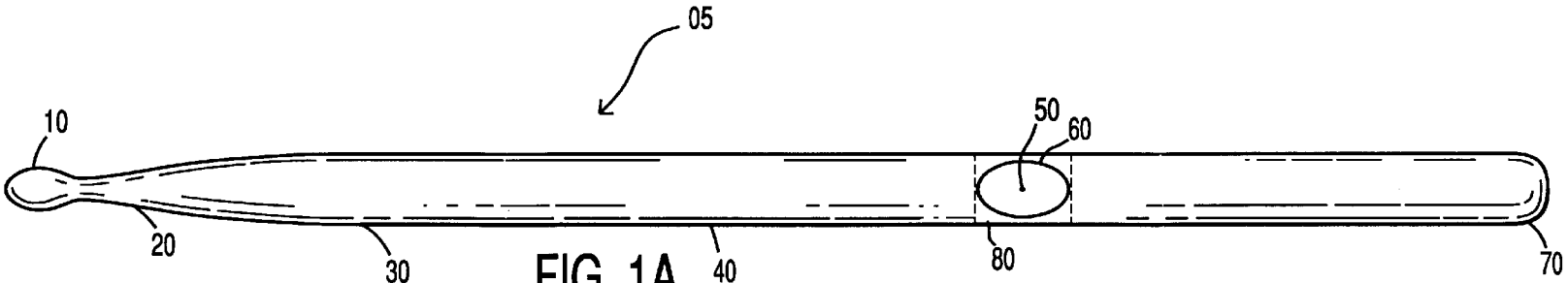
FIG. 1A is a longitudinal cross section of the drumstick having a pivot means and a pivot pin wherein the pivot means is parallel with the longitudinal axis of the drumstick.

Referring to the accompanying figures, FIG. 1A illustrates a drumstick 5 incorporating one embodiment of the present invention. The drumstick 5 is of conventional shape having a striking tip 10 and an elongated body 40. The elongated body 40 has a first end 30 and a second end 70 located at opposite longitudinal ends of the elongated body 40. The striking tip 10 is located at the first end 30 of the elongated body 40. As one travels along the elongated body from the first end 30 towards the second end 70, immediately after the first end 30 the drumstick begins to taper.

This tapered portion 20 of the elongated body 40 eventually expands out to a constant diameter of the drumstick. The length of the tapered portion 20 is a design choice and may vary from drumstick to drumstick. The elongated body 40 of the drumstick 5 terminates at the second end 70, which is sometimes referred to as the butt end of the drumstick.

The striking tip 10 discussed above, may be integral with the drumstick 5 or may be made out of a synthetic material such as metal, plastic, or resin with or without cloth or fibers and applied to the drumstick 5. The size of the strikng member 10 may also vary with the type of percussion instrument for which it is designed. For example, the drumstick 5 may be adapted to have a larger head to be used for the playing of tom-toms, cymbals, marimbas or any other percussion instrument that requires a larger striking tip. The striking tip 10 can also be changed to play the xylophone, cowbell, or triangle as well as other percussion instruments similar in nature to the ones already mentioned.

An integral part of the drumstick 5 of the present invention is a pivot means. The pivot means comprises a pivot pin 50 that is set in a hole (not shown) that goes through the elongated body 40 (from side to side) of the drumstick 5. The pivot pin has a circular cross section and moves freely in the hole bored in the drumstick. Attached to one end of the pivot pin 50 is a first pivot member 60 and attached to the other end is a second pivot member 65 (shown in FIG. 1C). The two pivot members and the pivot pin 50 together produce the pivot means.

The pivot means can be set in a cavity 80 so that the diameter of the drumstick 5, at its thickest point, is maintained. In an alternative embodiment, the pivot means can be attached to the drumstick so that there is a difference in the diameter of the drumstick at the point of attachment. Both embodiments are within the scope of the present invention.

The above embodiment of the present invention provides a drumstick that enables a drummer to firmly grip the drumstick, but at the same time reduces the friction between the percussionist's fingers/hands and the drumstick. When a percussionist's grips a drumstick a fulcrum is created, i.e., a pivoting point. However, in order to maintain control of the drumstick while playing, the percussionist must grip the drumstick firmly in his or hers fingers/hands. This creates friction between the fingers/hands of the percussionist and the drumsticks and that, reduces movement of the drumsticks.

The present invention provides a drumstick that enables the percussionist to firmly grip the drumstick in his/hers fingers/hands so as to maintain control of the drumstick but at the same time reduce the friction between the drumstick and the fingers/hands of the percussionist. When the percussionist grips the first and second members of the pivot means in his/her fingers/hands, these members pivot in a seesaw motion about the axis of the pivot pin. This motion is smooth and frictionless. As the front portion of the first member 60 and second member 65 of the pivot means moves in the downward direction, the first end 30 of the drumstick 5 moves in the upward direction. Consequently, as the front portion of the first member 60 and second member 65 of the pivot means moves in the upward direction, the first end 30 of the drumstick 5 moves in the downward direction.

A rapid repetition of the seesaw motion of the pivot means enables the percussionist to increase the speed at which he moves the drumsticks while maintaining a firm grip on the drumsticks.

Figure 1B:
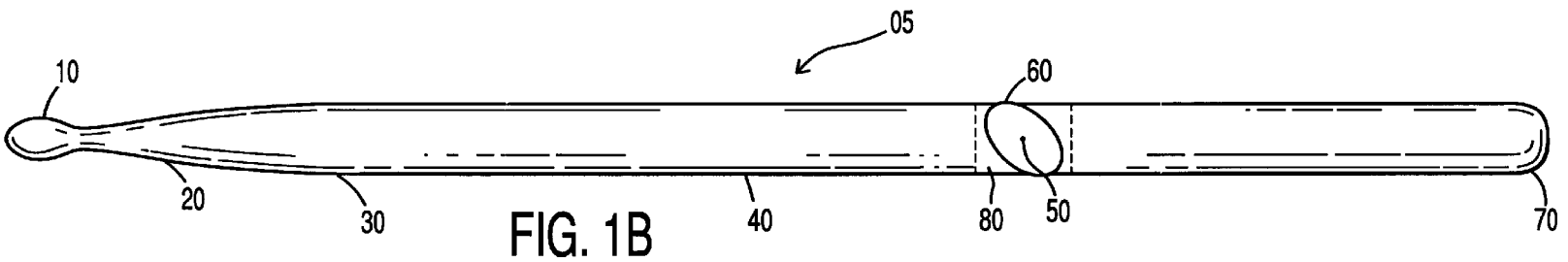
FIG. 1B is a longitudinal cross section of the drumstick having a pivot means and a pivot pin wherein the members of the pivot means are not parallel with the longitudinal axis of the drumstick.

FIG. 1B shows all of the elements shown in FIG. 1A, except the front portion of the first member 60 of the pivot means is tilted in the upward position and the first end 30 of the drumstick 5 is tilted in the downward direction, thus illustrating the see-saw movement explained above.

Figure 1C:
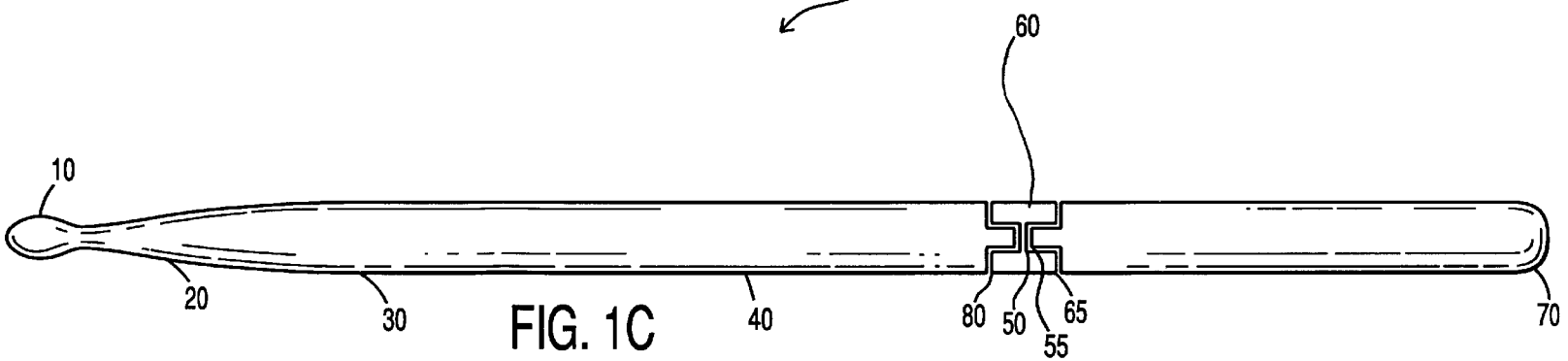
FIG. 1C is a longitudinal cross section of the drumstick rotated 90° from FIG. 1A position.

FIG. 1C illustrates the drumstick 5 of FIG. 1A, rotated 90° from the position shown in FIG. 1A. In this figure, in addition to the elements shown in FIG. 1A, a hole 55 in the elongated body 40 of the drumstick 5 that the pivot pin 50 rests is shown. The first member 60 and the second member 65 of the pivot means are shown connected to the pivot pin 50 and are positioned in the recessed cavity 80 of the drumstick 5.

The concentric wall defining the hole 55 may be lined with Teflon® or a Teflon®-like material so as to further reduce friction between the pivot pin and the surface of the concentric wall of the hole. Preferably, this arrangement reduces the friction to a point that it is essentially meaningless to the movement of the drumsticks.

The area between the hole 55 and the pivot pin 50 may also be lined with a plurality of ball bearing units that are axially retained and concentrically connected to the pivot pin 50 so as to reduce the friction between the pivot pin 50 and the surface of the concentric wall of the hole.

Figure 2A:
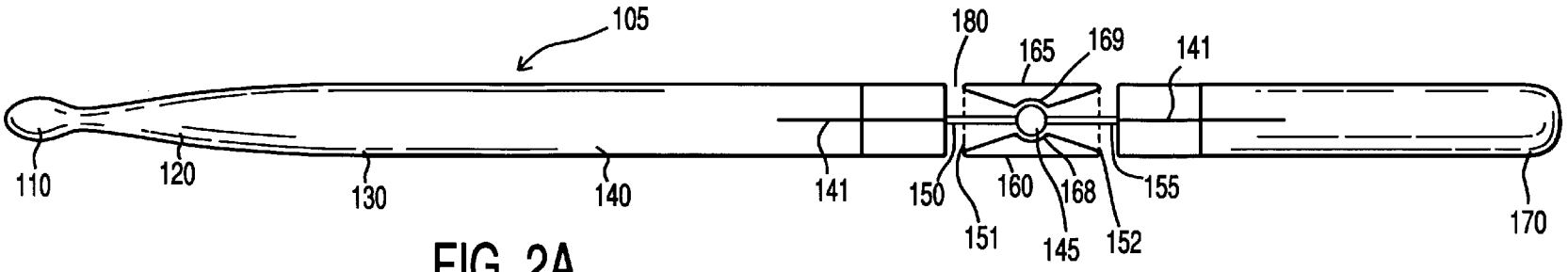
FIG. 2A is a longitudinal cross section of the drumstick having a pivot means comprising a ball and contouring members wherein the pivot means is parallel with the longitudinal axis of the drumstick.
Figure 2B:
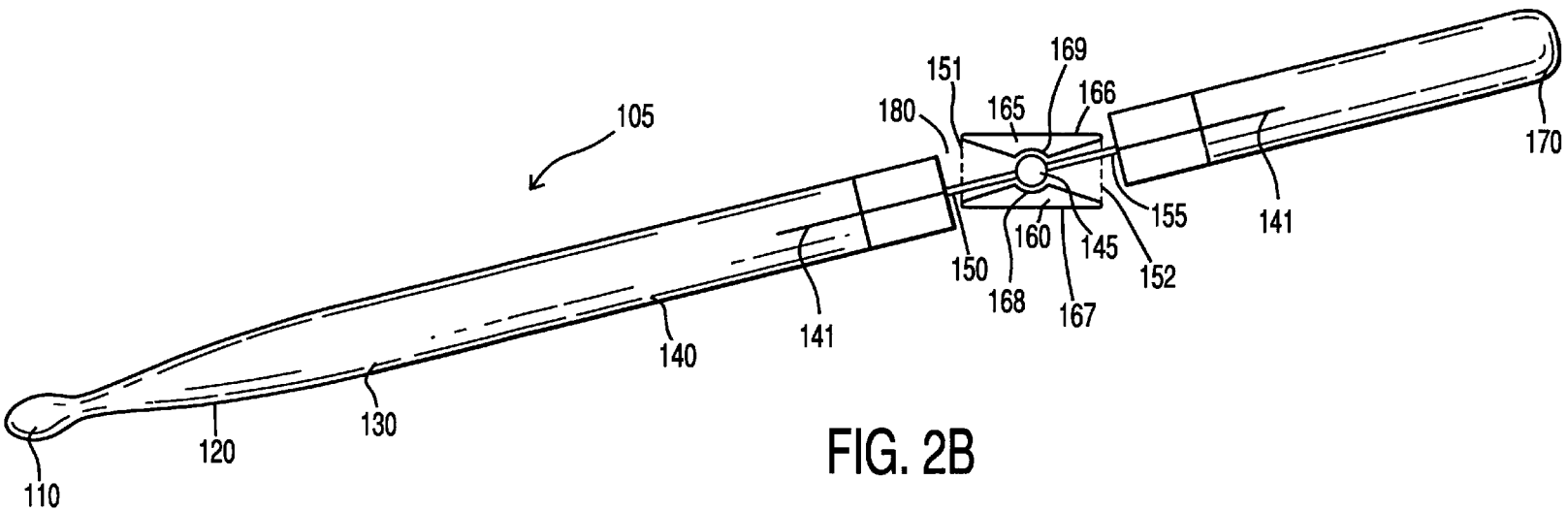
FIG. 2B is a longitudinal cross section of the drumstick having a pivot means comprising a ball and contouring members wherein the members of the pivot means are not parallel with the longitudinal axis of the drumstick.

Another embodiment of the invention is illustrated in FIGS. 2A and 2B. As in FIG. 1, the drumstick 105 has a striking tip 110 a tapered portion 120 located at the first end 130 of the drumstick 105. The drumstick also has an elongated body 140 and a second portion 170 of the drumstick, often referred to as the butt portion of the drumstick.

The pivot means of FIG. 2A comprises a ball 145 having a circular cross-section and first and second grip members 160 and 165, respectively. Each of the first and second grip members have outside surfaces 166 and 167 respectively, that face away from the ball 145 and inside surfaces 168 and 169 respectively that face towards the ball 145. At least a portion of the inside surfaces 168 and 169 are in contact with the ball 145 so that the first and second grips members 160 and 165 swivel about the ball 145 in a circular motion.

A cross section of the elongated tubular body 140 reveals a center axis 141. The ball 145 attaches to the center axis 141 of the elongated body 140 by a front support member 150 and a rear support member 155. The front member 150, the ball 145 and the rear member 155 form essentially a straight line from the front portion of the cavity 180 to the rear portion of the cavity 180. The inside surface 168 of the first grip member 160 and the inside surface 169 of the second grip member 170 partially encase the ball 145 of the pivot means. The first and second grip members are held together by front concentric guide 151 and a back concentric guide 152. The combination of these elements permit the first and second grip members to rotate about the circumference of the ball, thus permitting motion in an up to down motion as well as a side to side direction.

The cavity formed between the surface of the ball and the first and second inside surfaces of the grip members may also be lined with a plurality of ball bearing units that are axially retained and concentrically connected to the ball shaped member. This arrangement will reduce the friction between the surface of the ball member and the inside surfaces of the first and second grip members and allow for a smoother, frictionless motion of the drumstick. Both the surface of the ball member 145 and the inside surfaces of the grip members 168 and 169 may be coated with Teflon® or a Teflon®-like material so as to further also reduce friction.

This embodiment of the present invention provides a drumstick that when the percussionist firmly holds the first and second grip members of the pivot means in his/her fingers/hands, he/she is able to move the drumstick in a see-saw direction, a side-to-side direction, as well as, in a circular direction with reduced friction, preferably in frictionless motion.

FIG. 2B shows all of the elements shown in FIG. 2A except that the front portion of the first and second grip members 160 and 165 are tilted in the upward position and the first end 130 of the drumstick 105 is tilted in the downward direction, thus illustrating the see-saw movement explained above.

The drumsticks described herein can be made from wood or any other material that maintains a rigid shape. For example, the drumstick can be made of wood, plastic, metal, polyurethane or other rigid materials.

Figure 3A:
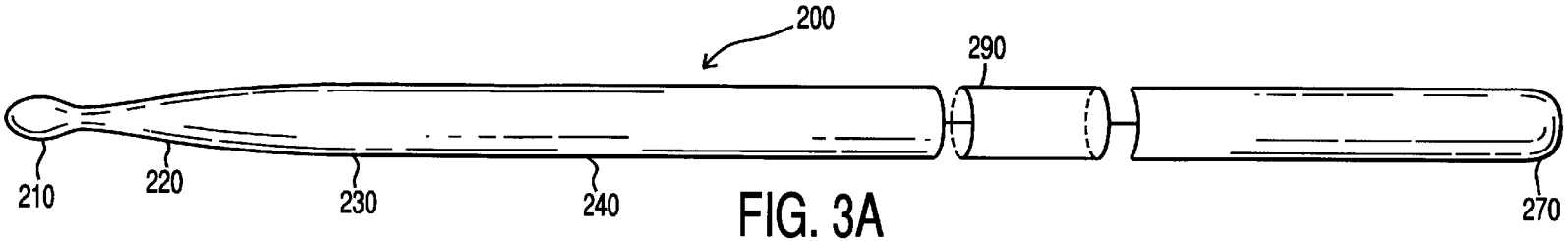
FIG. 3A is a longitudinal view of the drumstick having an elongated tubular grip having a bore longitudinally throughout.

FIG. 3A illustrates the drumstick incorporating one embodiment of the present invention. FIG. 3A shows all of the elements shown in FIG. 2A except the pivot means consist of a ball (shown in FIG. 3B) and an elongated tubular grip having a longitudinally positioned bore that surrounds the ball 245 completely. In other words, the grips completely enclose the ball 245 so that it allows up to 360° movements.

Figure 3B:
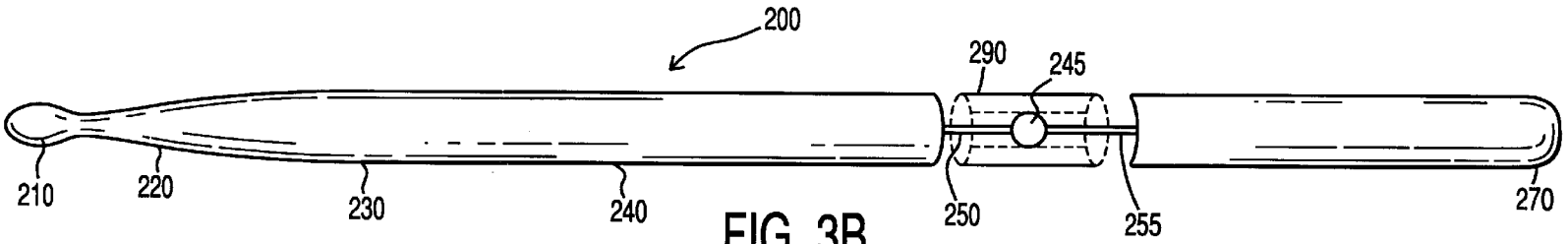
FIG. 3B is a longitudinal cross section of the drumstick having a pivot means comprising a ball set within the elongated tubular grip.

FIG. 3B is a longitudinal cross section of 3A showing the ball 245 surrounded by the inside wall of the elongated tubular grip.

Figure 3C:
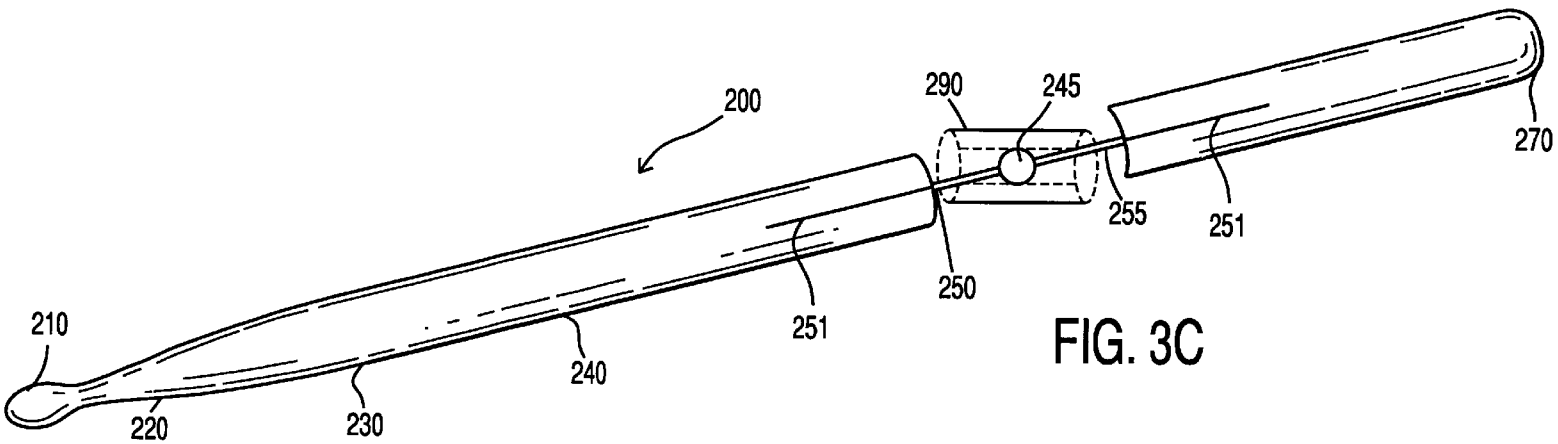
FIG. 3C shows the drumstick as shown in 3B wherein the first end of the drumstick is not parallel with the elongated tubular grip.

FIG. 3C shows all the elements of 3B except the front portion 230 of the drumstick is positioned below the longitudinal axis of the drumstick and the front portion of the grip 290 is above the longitudinal axis of the drumstick 200. As with the drumsticks described above, a rapid succession of this seesaw movement would allow the percussionist to move to a particular beat with reduced friction compared to conventional drumsticks.

The drumsticks described herein can be made from wood or any other material and any combination thereof that maintains a rigid shape. For example, the drumsticks can be made of wood, plastic, metal, polyurethane or other rigid materials.

In connection with the various forms of the invention shown here, it is readily visualized that numerous modifications to the concept herein disclosed, may be adopted without departing from the spirit and scope of the invention as set forth.

What is claimed is:

1. A drumstick comprising:

an elongated tubular body having a first end and a second end;

a striking tip continuous with the first end of the elongated tubular body;

a butt portion continuous with the second end of the elongated tubular body; and a pivot means having a front portion swivelably attached to the elongated tubular body wherein the first end of the elongated tubular body moves in an opposite direction compared to the front portion of the pivot means.

2. A drumstick according to claim 1 wherein the pivot means comprises a first member and a second member which are attached to opposite sides of the elongated tubular body at a pivot point.

3. A drumstick according to claim 1 wherein the pivot point is a pin having a circular cross-section and extends within semi-circular transverse slots defined in the first and second members of the pivot means and a point of attachment on the elongated tubular body.

4. A drumstick according to claim 2 wherein the first and second members of the pivot means are pivotally mounted within a cavity defined in the elongated tubular body of the drumstick so that the first and second members of the pivot means are flush with the rest of the elongated tubular body of the drumstick.

5. A drumstick according to claim 3 further comprising a plurality of ball bearing units being axially retained and concentrically connected to the pivot pin, allowing the pivot pin to rotate about a longitudinal axis of said pivot means.

6. A drumstick according to claim 5 wherein the pivot pin moves about the pivot means in a substantially frictionless manner.

7. A drumstick according to claim 1 further comprising a tapered portion of the tubular elongated body connected to the striking tip which is continuous with the first end of the elongated tubular body;

a straight portion of the elongated tubular body connected to the tapered portion terminating at the butt portion that is continuous with the second end of the elongated tubular body.

8. A drumstick according to claim 7 wherein the pivot knob is connected to the straight portion of the elongated member by the pivot means.

9. A drumstick according to claim 1 wherein the drumstick is wood.

10. A drumstick according to claim 1 wherein the drumstick is a synthetic material.

11. A drumstick according to claim 1 wherein the striking tip is selected from the group consisting of wood, metal and synthetic materials.

12. A drumstick according to claim 1 wherein the pivot means is detachable.

13. A drumstick comprising:

an elongated tubular body having a first end and a second end;

a string tip continuous with the first end of the elongated tubular body;

a butt portion continuous with the second end of the elongated tubular body; and a pivot means continuous with the longitudinal axis of the elongated tubular body comprising a ball having a circular cross-section and first and second grip members, each of the first and second grip members having an outside surface that faces away from the ball and an inside surface that faces towards the ball wherein at least a portion of said inside surface contours the ball so that the first and second grip members swivel about the ball.

14. A drumstick according to claim 13 wherein a cross section of the elongated tubular body reveals a center portion;

the ball being attached to the center portion of the elongated body by a front support member and a rear support member.

15. A drumstick according to claim 13 wherein the first and second grip members have a front portion and the first end of the elongated tubular body moves in an opposite direction compared to the front portion of the first and second grip members.

16. A drumstick according to claim 13 wherein the first and second grip members are pivotally mounted to the ball within a cavity defined in the elongated tubular body of the drumstick so that the outer surfaces of the first and second grip members are flush with the rest of the elongated tubular body of the drumstick.

17. A drumstick according to claim 13 further comprising a plurality of ball bearing units being axially retained and concentrically connected to the inside surfaces of said grip members whereby allowing the grip members to rotate about the contour of the ball.

18. A drumstick according to claim 17 wherein the grip members rotate 360° in an axis that is essentially perpendicular to the longitudinal axis of the elongated tubular body.

19. A drumstick according to claim 13 wherein the ball moves within the contour of the inside surfaces of the first and second grip members in a substantially frictionless manner.

20. A drumstick according to claim 13 further comprising a tapered portion of the tubular elongated body connected to the striking tip which is continuous with the first end of the elongated tubular body;

a straight portion of the elongated tubular body connected to the tapered portion terminating at the butt portion that is continuous with the second end of the elongated tubular body.

21. A drumstick according to claim 13 wherein the drumstick is wood.

22. A drumstick according to claim 13 wherein the drumstick is a synthetic material.

23. A drumstick according to claim 13 wherein the striking tip is metal or a synthetic material.

24. A drumstick comprising:

an elongated tubular body having a first end and a second end;

a striking tip continuous with the first end of the elongated tubular body;

a butt portion continuous with the second end of the elongated tubular body; and a pivot means continuous with the longitudinal axis of the elongated tubular body comprising a ball having a circular cross-section and an elongated tubular grip having a bore longitudinally throughout, the elongated tubular body having an outside surface that faces away from the ball and an inside surface that faces towards the ball wherein at least a portion of said inside surface contours the ball so that the drumstick swivels about the ball.

25. A drumstick according to claim 24 wherein a cross section of the elongated tubular grip reveals a center portion;

the ball being attached to the center portion of the elongated body by a front support member and a rear support member.

26. A drumstick according to claim 24 wherein the elongated tubular grip has a front portion and the first end of the elongated tubular body moves in an opposite direction compared to the front portion of the elongated tubular grip.

27. A drumstick according to claim 24 wherein the elongated tubular grip is pivotally mounted to the ball within a cavity defined in the elongated tubular body of the drumstick so that the outer surfaces of the first and second grip members are flush with the rest of the elongated tubular body of the drumstick.

28. A drumstick according to claim 24 further comprising a plurality of ball bearing units being axially retained and concentrically connected to the inside surfaces of the elongated tubular grip whereby allowing the grip members to rotate about the contour of the ball.

29. A drumstick according to claim 24 wherein said elongated tubular grip rotates 360° in an axis that is essentially perpendicular to the longitudinal axis of the elongated tubular body.

30. A drumstick according to claim 13 wherein the ball moves within the contour of the inside surfaces of the elongated tubular grip in a substantially frictionless manner.

31. A drumstick according to claim 24 further comprising a tapered portion of the tubular elongated body connected to the striking tip which is continuous with the first end of the elongated tubular body;

a straight portion of the elongated tubular body connected to the tapered portion terminating at the butt portion that is continuous with the second end of the elongated tubular body.

32. A drumstick according to claim 24 wherein the drumstick is made from materials selected from the group consisting of wood, metal, synthetic material and any combination thereof.

33. A drumstick comprising:

an elongated tubular body having a first end and a second end;

a striking tip continuous with the first end of the elongated tubular body;

a butt portion continuous with the second end of the elongated tubular body; and a pivot means comprising a first member and a second member which are attached to opposite sides of the elongated tubular body at a pivot point, said pivot point having a front portion swivelably attached to the elongated tubular body wherein the first end of the elongated tubular body moves in an opposite direction compared to the front portion of the pivot means.

34. A drumstick according to claim 33 wherein the pivot point is a pin having a circular cross-section and extends within semi-circular transverse slots defined in the first and second members of the pivot means and a point of attachment on the elongated tubular body.

35. A drumstick according to claim 34 wherein the first and second members of the pivot means are pivotally mounted within a cavity defined in the elongated tubular body of the drumstick so that the first and second members of the pivot means are flush with the rest of the elongated tubular body of the drumstick.

36. A drumstick according to claim 35 further comprising a plurality of ball bearing units being axially retained and concentrically connected to the pivot pin, allowing the pivot pin to rotate about a longitudinal axis of said pivot means.

37. A drumstick according to claim 35 wherein the pivot pin moves about the pivot means in a substantially frictionless manner.

38. A drumstick according to claim 33 further comprising a tapered portion of the tubular elongated body connected to the striking tip which is continuous with the first end of the elongated tubular body;

a straight portion of the elongated tubular body connected to the tapered portion terminating at the butt portion that is continuous with the second end of the elongated tubular body.

* * * * *